US008016911B2

(12) United States Patent
Hibino et al.

(10) Patent No.: US 8,016,911 B2
(45) Date of Patent: Sep. 13, 2011

(54) USE OF A PROTECTIVE GAS COMPOSITION FOR PREVENTING OXIDATION OR COMBUSTION OF MOLTEN MAGNESIUM

(75) Inventors: Yasuo Hibino, Saitama (JP); Ryoichi Tamai, Saitama (JP); Satoru Okamoto, Saitama (JP); Fuyuhiko Sakyu, Saitama (JP)

(73) Assignee: Central Glass Company, Limited, Ube-shi (JP)

( * ) Notice: Subject to any disclaimer, the term of this patent is extended or adjusted under 35 U.S.C. 154(b) by 0 days.

(21) Appl. No.: 12/824,637

(22) Filed: Jun. 28, 2010

(65) Prior Publication Data

US 2010/0263489 A1 Oct. 21, 2010

Related U.S. Application Data

(62) Division of application No. 11/884,734, filed as application No. PCT/JP2006/308766 on Apr. 26, 2006.

(30) Foreign Application Priority Data

Apr. 27, 2005 (JP) ..... 2005-129530
Apr. 14, 2006 (JP) ..... 2006-112025

(51) Int. Cl.
*C22B 26/22* (2006.01)

(52) U.S. Cl. ..... 75/594; 75/600; 75/602; 148/242; 169/44; 169/45; 252/372

(58) Field of Classification Search ..... 75/594, 75/600, 602; 252/372; 148/242; 169/44–45
See application file for complete search history.

(56) References Cited

U.S. PATENT DOCUMENTS

| | | | |
|---|---|---|---|
| 1,972,317 | A | 9/1934 | Reimers |
| 5,278,342 | A | 1/1994 | O'Neill et al. |
| 5,405,428 | A | 4/1995 | Dubé et al. |
| 6,369,284 | B1 | 4/2002 | Nappa et al. |
| 6,929,674 | B1 | 8/2005 | Ricketts et al. |
| 2003/0034094 | A1 | 2/2003 | Milbrath et al. |
| 2003/0164068 | A1 | 9/2003 | Milbrath et al. |
| 2004/0195544 | A1 | 10/2004 | Richard et al. |
| 2005/0070746 | A1 | 3/2005 | Tung et al. |
| 2005/0241805 | A1 | 11/2005 | Singh et al. |
| 2006/0144190 | A1 | 7/2006 | Sanui et al. |

FOREIGN PATENT DOCUMENTS

| | | | |
|---|---|---|---|
| CN | 1352583 | A | 6/2002 |
| JP | 2002-541999 | A | 12/2002 |
| JP | 2004-9110 | A | 5/2004 |
| JP | 2004-276116 | A | 10/2004 |
| WO | WO 00/64614 | A1 | 11/2000 |
| WO | WO 2004/037752 | A2 | 5/2004 |
| WO | WO 2004/090177 | A1 | 10/2004 |
| WO | WO 2008/005920 | A2 | 1/2008 |

OTHER PUBLICATIONS

International Search Report dated Aug. 15, 2006 with English translation (two (2) pages).
Chinese Office Action including English translation dated May 15, 2008 (Nine (9) pages).
Extended European Search Report dated Feb. 27, 2009 (Seven (7) pages).
Korean Office Action dated Nov. 27, 2009, Four (4) pages.
Co-pending patent Aplication No. 12/095,671 filed Nov. 1, 2006.

*Primary Examiner* — Roy King
*Assistant Examiner* — Lois Zheng
(74) *Attorney, Agent, or Firm* — Crowell & Moring LLP

(57) ABSTRACT

A method of using a protective gas composition comprising a fluorine-containing organic compound and a carrier gas for preventing a rapid oxidation or combustion of a molten magnesium/magnesium alloy alloy in a magnesium or magnesium alloy production process.

6 Claims, No Drawings

USE OF A PROTECTIVE GAS COMPOSITION FOR PREVENTING OXIDATION OR COMBUSTION OF MOLTEN MAGNESIUM

CROSS REFERENCE TO RELATED APPLICATIONS

This application is a division of co-pending application Ser. No. 11/884,734, which is the US national stage of international patent application no. PCT/JP2006/308766, filed Apr. 26, 2006 designating the United States of America and published in Japanese on Nov. 9, 2006 as WO 2006/118157, the entire disclosure of which is incorporated herein by reference. Priority is claimed based on Japanese patent applications nos. JP 2005-129530, filed Apr. 27, 2005, and JP 2006-112025, filed Apr. 14, 2006.

TECHNICAL FIELD

The present invention relates to a protective gas for preventing oxidation or combustion of molten magnesium/magnesium alloy. Furthermore, the present invention relates to a method for preventing oxidation or combustion of molten magnesium or magnesium alloy.

BACKGROUND OF THE INVENTION

It is known that molten magnesium and magnesium alloy vigorously react with oxygen in the air to form an oxide and to combust. In order to prevent oxidation of molten magnesium and magnesium alloy, there is used a method of applying a protective flux on molten metal, a method of protecting it with an inert gas such as helium, argon or nitrogen, or a method of covering it with a protective gas.

Hitherto, sulfur dioxide ($SO_2$), sulfur hexafluoride ($SF_6$), etc. have been used as protective gases in magnesium and magnesium alloy production steps. The former has a low price, but its use is limited since it is relatively high in odor and toxicity. The latter has widely been used because of low toxicity and ease to handle. Its global warming potential (GWP) is, however, about 24,000 times that of carbon dioxide ($CO_2$), and it has a very long atmospheric lifetime of 3,200 years. Therefore, its emission is limited in Kyoto Protocol.

Various fluorine compounds have been proposed as protective gases alternative to $SF_6$. For example, difluoromethane (HFC-32), pentafluoroethane (HFC-125), 1,1,1,2-tetrafluoroethane (HFC-134a), difluoroethane (HFC-152a), heptafluoropropane (HFC-227ea), methoxy-nonafluoroethane (HFE-7100), ethoxy-nonafluoroethane (HFE-7200), and dihydrodecafluoropentane (HFC-43-10mee) are cited in Patent Publication 1, Japanese Patent Application Publication 2002-541999, and HFC-134a and dry air are recommended therein as a preferable composition. Furthermore, perfluoroketones, ketone hydrides and their mixtures are cited in Patent Publication 2, US Patent Application Publication 2003/0034094, Patent Publication 3, US Patent Application Publication 2003/0164068, and Patent Publication 4, Japanese Patent Application Publication 2004-276116, and pentafluoroethyl-heptafluoropropyl ketone ($C_3F_7(CO)C_2F_5$) is specifically shown therein as an example. Furthermore, boron trifluoride ($BF_3$), silicon tetrafluoride ($SiF_4$), nitrogen trifluoride ($NF_3$), and sulfuryl fluoride ($SO_2F_2$) are cited in Patent Publication 5, U.S. Pat. No. 1,972,317.

Patent Publication 1: Japanese Patent Application Publication 2002-541999

Patent Publication 2: US Patent Application Publication 2003/0034094

Patent Publication 3: US Patent Application Publication 2003/0164068

Patent Publication 4: Japanese Patent Application Publication 2004-276116

Patent Publication 5: U.S. Pat. No. 1,972,317

SUMMARY OF THE INVENTION

Substances proposed hitherto as protective gases alternative to $SF_6$ have problems that they themselves have high toxicity, that they produce toxic gases by contact with molten magnesium or magnesium alloy, or that they have high prices, or problems of combustibility, etc. Thus, a novel protective gas that can solve these problems is demanded.

It is an object of the present invention to provide novel compositions that have a small global warming potential, a low impact on the environment, and a low toxicity and that are noncombustible, as protective gases that are effective for preventing combustion by a vigorous oxidation in magnesium and magnesium alloy production, and to provide a method using them.

The present inventors have examined various fluorine-containing organic compounds to solve the above task and have found a protective gas composition that has relatively small GWP, low toxicity, and incombustibility, thereby reaching the present invention.

According to the present invention, there is provided a protective gas composition that is effective for preventing combustion by a rapid oxidation in contact with molten magnesium or magnesium alloy and that comprises a fluorine-containing organic compound and a carrier gas.

Furthermore, according to the present invention, there is provided a method for preventing a rapid oxidation or combustion of molten magnesium or magnesium alloy, which is characterized in that the above gas composition is used as a protective gas that prevents rapid oxidation or combustion of molten magnesium or magnesium alloy in magnesium or magnesium alloy production.

DETAILED DESCRIPTION

A protective gas composition of the present invention, comprising a fluorine-containing organic compound and a carrier gas, is a gas composition for protecting molten magnesium/magnesium alloy, the composition having relatively small GWP as compared with conventional protective gases, low toxicity, and little production of decomposable toxic gases. Therefore, it is possible to reduce the environmental load and to increase safety upon operation.

Fluorine-containing organic compounds used in the present invention are desirably remarkably small, preferably 1,000 or less, in GWP relative to $SF_6$ used hitherto, from the viewpoint of the global environmental protection. From such viewpoint, HFC-125, HFC-134a, HFC-227ea, etc. are relatively large in GWP. Therefore, it is difficult to say that they are preferable. Although HFC-152a and HFC-32 have small GWP, these compounds are small in effective F content in the molecule and high in combustibility. Therefore, there are difficulties in terms of the effect of preventing combustion of molten magnesium or magnesium alloy and in terms of handling. Thus, it is difficult to say that they are preferable. Although they are expected to have a high protective effect, high toxicity compounds, such as $BF_3$, $SiF_4$, $NF_3$ and $SO_2F_2$, are not necessarily preferable from the operator health side and safety upon use.

Although the mechanism for protecting molten magnesium or magnesium alloy by $SF_6$ is not clear, the following reaction is cited (J. F. King, Magnesium, 2003, Vol. 32, (11), p 1). In this case, it is shown that the protective film is firstly magnesium oxide (MgO), and it reacts further with $SF_6$ to become magnesium fluoride ($MgF_2$). That is, it is considered that F carries out an important function in protection of molten magnesium or magnesium alloy. Therefore, one having a greater F content in the protective gas molecule is considered to be advantageous to form the protective film.

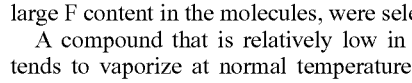

$$2Mg\ (liquid)+O_2 \rightarrow 2MgO\ (solid)$$

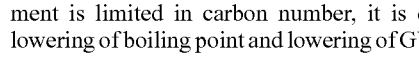

$$2Mg\ (liquid)+O_2+SF_6 \rightarrow 2MgF_2\ (solid)+SO_2F_2$$

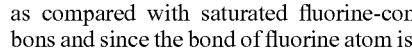

$$2MgO\ (solid)+SF_6 \rightarrow 2MgF_2+SO_2F_2$$

In the present invention, when fluorine-containing organic compounds are used as protective gases, hydrofluorocarbons and hydrofluoroethers, such as 1,1,1,3,3-pentafluoropropane, 1,3,3,3-tetrafluoropropene, and methyl 1,1,2,2-tetrafluoroethyl ether, which have relatively small GWP and relatively large F content in the molecules, were selected.

A compound that is relatively low in boiling point and tends to vaporize at normal temperature is desired as the protective gas. Although a compound satisfying this requirement is limited in carbon number, it is expected to have lowering of boiling point and lowering of GWP by containing an unsaturated bond in the molecule. A double bond in the molecule is preferable, since it increases affinity to metal Mg as compared with saturated fluorine-containing hydrocarbons and since the bond of fluorine atom is not easily broken, thereby exhibiting advantageous effects by a low concentration. A fluorinated propene that has a double bond in the molecule and that is relatively large in F content is preferable. As such compound, there can be mentioned 1,1,3,3,3-pentafluoropropene, 1,2,3,3,3-pentafluoropropene, 1,1,2,3,3-pentafluoropropene, 2,3,3,3-tetrafluoropropene, 3,3,3-trifluoropropene, etc., besides 1,3,3,3-tetrafluoropropene.

Furthermore, can be also used a compound containing an oxygen atom(s), since oxygen atom is expected by an interaction with magnesium to become magnesium oxide that becomes a protective film. Although the fire retardancy effect of magnesium has not been clarified in detail, the existence of $MgF_2$ and MgO is important. Thus, a correlation with the ratio of oxygen atoms and fluorine atoms as atoms in the protective gas is estimated. It is preferable that the numerical value of (F+O)/(F+O+C+H) is relatively large. As such hydrofluoroethers that contain oxygen atom in the molecule, that is relatively low in boiling point, and that tends to vaporize at normal temperature, there can be mentioned difluoromethyl fluoromethyl ether, bisdifluoromethyl ether, methyl pentafluoroethyl ether, 1,2,2,2-tetrafluoroethyl trifluoromethyl ether, 2,2,2-trifluoroethyl trifluoromethyl ether, difluoromethyl 1,2,2,2-tetrafluoroethyl ether, difluoromethyl 2,2,2-trifluoroethyl ether, 1-trifluoromethyl-2,2,2-trifluoroethyl methyl ether, 1-trifluoromethyl-1,2,2,2-tetrafluoroethyl methyl ether, 1,1,1,2,2,3,3-heptafluoro-3-methoxypropane, etc., besides methyl 1,1,2,2-tetrafluoroethyl ether.

1,1,1,3,3-pentafluoropropane is obtained, for example, by subjecting 1,1,1,3,3-pentachloropropane to a two-step fluorination by anhydrous hydrofluoric acid. 1,3,3,3-tetrafluoropropene can be obtained by treating 1,1,1,3,3-pentafluoropropane with potassium hydroxide or the like or by fluorinating 1-chloro-3,3,3-trifluoropropene in gas phase in the presence of catalyst.

A hydrofluoroether can be produced by adding alcohol to fluoroolefin in the presence of a basic catalyst. For example, methyl 1,1,2,2-tetrafluoroethyl ether can be obtained by adding methanol to tetrafluoroethylene in the presence of a basic catalyst.

Regarding other fluorinated propenes, it is known that 1,2,3,3,3-pentafluoropropene is obtained by hydrogenation and dehydrofluorination from hexafluoropropene, which is easily available, and that 2,3,3,3-tetrafluoropropene is obtained by further hydrogenation and dehydrofluorination (I. L. Knunyants et al., IZv. Akad. Nauk SSSR, 1960, p 1312).

It is desirable that the fluorine-containing organic compounds are in the form of gas or easily vaporize at normal temperature. Boiling points of respective compounds of the present invention are 1,1,1,3,3-pentafluoropropane (15° C.), 1,3,3,3-tetrafluoropropene (−16° C.), and methyl 1,1,2,2-tetrafluoroethyl methyl (37° C.). These fluorine-containing organic compounds can be used alone or in mixture.

An inert gas is selected as the carrier gas. Air, carbon dioxide, argon, nitrogen, and mixtures of these are preferable. In the case of using a combustible hydrofluoroether such as methyl 1,1,2,2-tetrafluoroethyl ether, it is particularly preferable to mix a noncombustible carrier gas, such as carbon dioxide, argon and nitrogen.

The concentration of the fluorine-containing organic compound in the carrier gas is preferably 0.005-10 volume %, desirably 0.01-5 volume %. If the concentration of the fluorine-containing organic compound is too low, it can be difficult to obtain a protective effect. If it is excessive, decomposition products derived from the protective gas can increase. This adds an adverse effect to magnesium or magnesium alloy, and an undesirable effect may be produced in the operation environment. Therefore, it is not desirable.

It can be used the protective gas of the present invention by having the target concentration through previously adjusting the concentration and as it is, or through separately adjusting respective flow rates, and then by allowing it to continuously flow to an upper part of the molten magnesium or magnesium alloy.

Although it is specifically described by showing examples of the present invention, the present invention is not limited by these examples.

Example 1

While allowing a 0.1 volume % 1,1,1,3,3-pentafluoropropane/dry air mixed gas to flow at 10 ml/minute to an upper part of magnesium of a crucible furnace charged with 50 g of the magnesium, the crucible furnace was heated to 700° C., thereby melting the magnesium. As a result of observation with naked eyes, an upper part film was formed, and a vigorous combustion was not observed.

Example 2

While allowing a 0.1 volume % 1,3,3,3-tetrafluoropropene/dry air mixed gas to flow at 10 ml/minute to an upper part of magnesium of a crucible furnace charged with 50 g of the magnesium, the crucible furnace was heated to 700° C., thereby melting the magnesium. As a result of observation with naked eyes, an upper part film was formed, and a vigorous combustion was not observed.

Example 3

While allowing a 0.2 volume % methyl 1,1,2,2-tetrafluoroethyl ether/carbon dioxide mixed gas to flow at 10 ml/minute to an upper part of magnesium of a crucible furnace charged with 50 g of the magnesium, the crucible furnace was heated to 700° C., thereby melting the magnesium. As a result of observation with naked eyes, an upper part film was formed, and a vigorous combustion was not observed.

Examples 4-14

It was conducted in the same manner as that of Example 3, except in that methyl trifluoromethyl ether, difluoromethyl fluoromethyl ether, bisdifluoromethyl ether, methyl pentafluoroethyl ether, 1,2,2,2-tetrafluoroethyl trifluoromethyl ether, 2,2,2-trifluoroethyl trifluoromethyl ether, difluoromethyl 1,2,2,2-tetrafluoroethyl ether, difluoromethyl 2,2,2-trifluoroethyl ether, 1-trifluoromethyl-2,2,2-trifluoroethyl methyl ether, 1-trifluoromethyl-1,2,2,2-tetrafluoroethyl methyl ether, or 1,1,1,2,2,3,3-heptafluoro-3-methoxypropane was used as the protective gas. In each except methyl trifluoromethyl ether, an upper part film was formed, and a vigorous combustion was not observed, in an observation with naked eyes. The results are summarized in Table 1.

TABLE 1

| Examples | Protective Gas | Evaluation |
|---|---|---|
| Ex. 4 | methyl trifluoromethyl ether | Δ |
| Ex. 5 | difluoromethyl fluoromethyl ether | ○ |
| Ex. 6 | bisdifluoromethyl ether | ○ |
| Ex. 7 | methyl pentafluoroethyl ether | ○ |
| Ex. 8 | 1,2,2,2-tetrafluoroethyl trifluoromethyl ether | ○ |
| Ex. 9 | 2,2,2-trifluoroethyl trifluoromethyl ether | ○ |
| Ex. 10 | difluoromethyl 1,2,2,2-tetrafluoroethyl ether | ○ |
| Ex. 11 | difluoromethyl 2,2,2-trifluoroethyl ether | ○ |
| Ex. 12 | 1-trifluoromethyl-2,2,2-trifluoroethyl methyl ether | ○ |
| Ex. 13 | 1-trifluoromethyl-1,2,2,2-tetrafluoroethyl methyl ether | ○ |
| Ex. 14 | 1,1,1,2,2,3,3-heptafluoro-3-methoxypropane | ○ |

Evaluation:
○: In an observation with naked eyes, a film was formed, and a vigorous combustion was not observed.
Δ: In an observation with naked eyes, a partial combustion was recognized, but it did not extend.

Examples 15-19

It was conducted in the same manner as that of Example 3, except in that 1,1,3,3,3-pentafluoropropene, 1,2,3,3,3-pentafluoropropene, 1,1,2,3,3-pentafluoropropene, 2,3,3,3-tetrafluoropropene, or 3,3,3-trifluoropropene was used as the protective gas. In each except 3,3,3-trifluoropropene, a film was formed on an upper part of the surface of the molten magnesium, and a vigorous combustion was not observed, in an observation with naked eyes. The results are summarized in Table 2.

TABLE 2

| Examples | Protective Gas | Evaluation |
|---|---|---|
| Ex. 15 | 1,1,3,3,3-pentafluoropropene | ○ |
| Ex. 16 | 1,2,3,3,3-pentafluoropropene | ○ |
| Ex. 17 | 1,1,2,3,3-pentafluoropropene | ○ |
| Ex. 18 | 2,3,3,3-tetrafluoropropene | ○ |
| Ex. 19 | 3,3,3-trifluoropropene | Δ |

Evaluation:
○: In an observation with naked eyes, a film was formed, and a vigorous combustion was not observed.
Δ: In an observation with naked eyes, a partial combustion was recognized, but it did not extend.

Comparative Example 1

While allowing a dry air to flow at 10 ml/minute to an upper part of magnesium of a crucible furnace charged with 10 g of the magnesium, the crucible furnace was heated to 700° C. In this case, a vigorous combustion of the magnesium was observed with the heating.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A method for preventing a rapid oxidation or combustion of a molten magnesium or magnesium alloy, comprising using a gas composition as a protective gas for preventing an oxidation or combustion of a molten magnesium or magnesium alloy in a magnesium or magnesium alloy production process, wherein the gas composition contains a fluorine-containing organic compound and a carrier gas, the fluorine-containing organic compound is selected from the group consisting of a hydrofluorocarbon, a hydrofluoroether, and mixtures of at least two of the foregoing, the hydrofluorocarbon is selected from the group consisting of 1,1,3,3,3-pentafluoropropene, 1,2,3,3,3-pentafluoropropene, 1,1,2,3,3-pentafluoropropene, 2,3,3,3-tetrafluoropropene, 3,3,3-trifluoropropene, and mixtures of at least two of the foregoing, and the hydrofluoroether is selected from the group consisting of difluoromethyl fluoromethyl ether, bisdifluoromethyl ether, methyl pentafluoroethyl ether, 1,2,2,2-tetrafluoroethyl trifluoromethyl ether, 2,2,2-trifluoroethyl trifluoromethyl ether, difluoromethyl 1,2,2,2-tetrafluoroethyl ether, difluoromethyl 2,2,2-trifluoroethyl ether, 1-trifluoromethyl-2,2,2-trifluoroethyl methyl ether, 1-trifluoromethyl-1,2,2,2-tetrafluoroethyl methyl ether, 1,1,1,2,2,3,3-heptafluoro-3-methoxypropane, and mixtures of at least two of the foregoing.

2. A method according to claim 1, wherein the gas composition is used by allowing the gas composition to continuously flow to an upper part of the molten magnesium or magnesium alloy.

3. A method according to claim 2, wherein the molten magnesium or magnesium alloy is in a crucible furnace.

4. A method according to claim 1, wherein the carrier gas is selected from the group consisting of air, carbon dioxide, argon, nitrogen, and mixtures of at least two of the foregoing.

5. A method according to claim 1, wherein concentration of the fluorine-containing organic compound in the carrier gas is 0.005-10 volume %.

6. A method according to claim 1, wherein concentration of the fluorine-containing organic compound in the carrier gas is 0.01-5 volume %.

* * * * *